United States Patent [19]

Fletcher et al.

[11] 3,977,147

[45] Aug. 31, 1976

[54] FLANGED MAJOR MODULAR ASSEMBLY JIG

[76] Inventors: James C. Fletcher, Administrator of the National Aeronautics and Space Administration, with respect to an invention of Meyer M. Gilman, Sherman Oakes, Calif.

[22] Filed: Oct. 25, 1974

[21] Appl. No.: 517,995

[52] U.S. Cl. ..... 52/648; 52/749; 52/637; 52/236; 52/745; 52/726; 52/651; 29/526; 182/178; 29/467

[51] Int. Cl.[2] ..... E04G 7/00; E04H 12/00; E04G 21/14

[58] Field of Search ..... 182/178; 52/637, 638, 52/726, 758, 758 F, 758 H, 749, 745, 648; 403/11–14; 408/72; 33/174 G, 189; 29/467, 526

[56] References Cited

UNITED STATES PATENTS

| | | | |
|---|---|---|---|
| 742,755 | 10/1903 | Uffelman | 52/638 |
| 870,696 | 11/1907 | Stetler | 182/178 |
| 1,373,979 | 5/1921 | Ryals | 52/726 |
| 1,712,453 | 5/1929 | Bieder | 408/72 |
| 2,590,929 | 4/1952 | Bush | 52/758 H |
| 3,053,558 | 9/1962 | Challas et al. | 182/178 |
| 3,264,941 | 8/1966 | Miraglia | 408/72 |
| 3,564,802 | 2/1971 | Dreyfus | 52/637 |
| 3,650,081 | 3/1972 | McCracken | 52/637 |
| 3,807,120 | 4/1974 | Viandon | 52/638 |
| 3,813,179 | 5/1974 | Priest | 52/758 F |

*Primary Examiner*—Ernest R. Purser
*Assistant Examiner*—James L. Ridgill, Jr.
*Attorney, Agent, or Firm*—Carl O. McClenny; John R. Manning; Marvin F. Matthews

[57] ABSTRACT

Sets of flanges are attached to sets of beam ends projecting from a major modular assembly jig structure made of three intersecting sets of unmachined box beams welded together. From each surface of the welded structure a number of beam ends project outwardly, and such members, owing to the weld method of construction, are approximately parallel, are spaced from each other approximately to conform to a predetermined pattern, and terminate approximately in a common plane.

Flanges are attached to such beam ends in such manner that the outer surfaces of the flanges are accurately coplanar and are accurately spaced from one another according to the predetermined pattern. Each flange consists of a pad, a collar surrounding the beam end and partially receiving its terminal portion to leave a gap between beam end and pad, and various connecting members. The collar is connected to the pad both by a set of machine screws passing through slightly oversize holes in the collar and into tapped holes in the pad, and by a pair of dowel pins driven through registering holes in both members.

14 Claims, 9 Drawing Figures

FLANGED MAJOR MODULAR ASSEMBLY JIG

ORIGIN OF THE INVENTION

The invention described herein was made in the performance of work under a NASA Contract and is subject to the provisions of Section 305 of the National Aeronautics and Space Act of 1958, Public Law 85-568(72 Stat.435; 45 USC 2547).

BACKGROUND OF THE INVENTION

1. Field of the Invention

This invention lies in the field of the attachment of flanges, the term flanges being understood to mean load-bearing terminations attached to other members and having a lateral area larger than the members to which they are attached. More particularly, the present invention deals with methods and means for attaching such flanges to three-dimensional frameworks which are also called major modular assembly jigs, the word "major" implying a structure of some size while "modular" is intended to connote that two or more jigs are to be assembled to make a complete tooling and assembly jig. As illustrated, the overall assembly of modules (plus some additional members) provides working platforms and reference points and plates for the assembly and tool operation upon such large structures as spacecraft, aircraft, sea-going vessels and rail cars.

2. Description of the Prior Art

The only relevant prior art known to the applicant are three-dimensional modules generally similar to those discussed herein, wherein the flanges are attached by welding. These all-welded structures have the usual disadvantages usually associated with welding, e.g., lack of accurate dimensioning, lack of needed co-planarity and lack of needed parallelism. It is difficult to stack one such module on top of another, because pre-drilled holes do not align properly, and adjustments must be made. Also, one set of flanges will not lie exactly on the other set, so shimming between some pairs of adjacent flanges pads must be resorted to; this may also be true of the bottom set of flanges, which are to support the framework on a floor or other rest, for if shims are not used the structure may deviate considerably from the vertical. Such welded-flange frameworks are highly unsatisfactory for re-use when a second spacecraft is to be put together, as it is generally less frustrating to start from scratch and build a new framework (scrapping the old one).

SUMMARY OF THE INVENTION

Accordingly, it is the principal object of the present invention to furnish weldless methods and means for securing flanges to the projecting ends of an unmachined box beam framework in such manner that the flanged structure may be reused without modification, and one such framework may be readily assembled to another by simply matching the flanges together and passing connecting members between preformed holes in the structures. Other objects are to make any one set of flanges coplanar and perpendicular to the box beams, with center holes through the flanges which are accurately spaced from one another according to a predetermined pattern. Another object is to provide such sets of flanges on more than one set of projecting beam ends; the load-bearing surfaces of the flanges may be perpendicular or parallel, with the hole-spacing pattern of one set of surfaces accurately spaced and located with respect to the other, or any number of the sets of projecting beam ends may be thus flanged.

Stated another way, the flanged beam frameworks are to be made replaceable and reusable, avoiding the need for machining, re-drilling holes and the like.

The major modular assembly jig is a three-dimensional framework of rectangular parallelepiped form wherein the twelve edges of the parallelepiped are defined by box beams welded together at the eight corners, and in one or more of the three dimensions there are intermediate box beams extending between and welded to a pair of the parallel edge beams. Each of the beams has an end projecting outwardly from its intersection with the other beams, so that there are three such beam ends at each of the eight corners and two beam ends projecting from each intermediate beam intersection. Since the beam ends form projections of the roughly parallel box beams, there are a multiplicity of at least four beam ends projecting in the same direction from each surface of the welded structure, at the four corners thereof. Such beam ends are approximately parallel and terminate approximately but not accurately in a common plane; in addition, such beam ends have center lines which are approximately spaced from one another according to a predetermined pattern.

These beam ends are flanged by the use of a rectangular plate having parallel upper and lower surfaces, a collar slidable on the beam ends, and various connecting members securing plate to collar and collar to beam end. The plate has cross-sectional dimensions which are considerably larger than those of the beams, e.g., twice as large, while the collar has intermediate dimensions. The collar-to-pad connections include machine screws which allow some lateral relative movement when partially loosened, and a pair of dowel pins driven through registering openings to stifle such movement. Flexibility in assembly is also provided by fitting the beam ends less than the full distance into the flange collars, whereas the collars are tightly fitted against the pads.

The flanges are built onto the beam ends with the assistance of a surface table having holes therein which are accurately spaced from one another according to a predetermined pattern, and the pads are temporarily fixed to the surface table by pins passing through center holes in the pads. The pads are also aligned to have parallel edges, and are temporarily held in such position by appropriate clamps. The welded structure is suspended above such pads so that the downwardly extending beam ends are as nearly vertical as possible, and with each beam end approximately centered on its pad. It is important, however, that in such suspended position there is a small gap, e.g., 0.635 cm. (1/4 inch) between the pad and the lower terminations of the beam ends. At this point the flange collars are allowed to slide down the beam ends until they contact the flange pads, after which the collars are tightened to the beam ends by the use of shims.

The remaining steps involve the connecting of the parts together by use of the mentioned machine screws and dowel pins. Use is made of a special bushing to align what are to be the registering dowel holes in collars and pads, and thereafter a special step pin is inserted in such holes and clamped in place while machine screws holes are formed in the same members, counterdrilled in the collars and tapped in the pads. The machine screws are then tightened to clamp the pads and collars together, the special step pins removed and the incipient dowel holes drilled and reamed out to size, and the dowel pins driven home. All that remains is to dowel the collars to the beam ends.

An optional feature is the use of shear and gage plates secured to the beam ends and butted against the collars. It is preferable to use two shear and gage plates per beam end, locating them on opposed walls of the beam, and to secure them to the beam by a pair of machine screws and a center dowel.

BRIEF DESCRIPTION OF THE DRAWING FIGURES

A drawing is appended to the present specification to illustrate the present invention, but it is to be understood that the drawing is intended as illustration and not by way of limitation. In the drawing.

Figure 8:
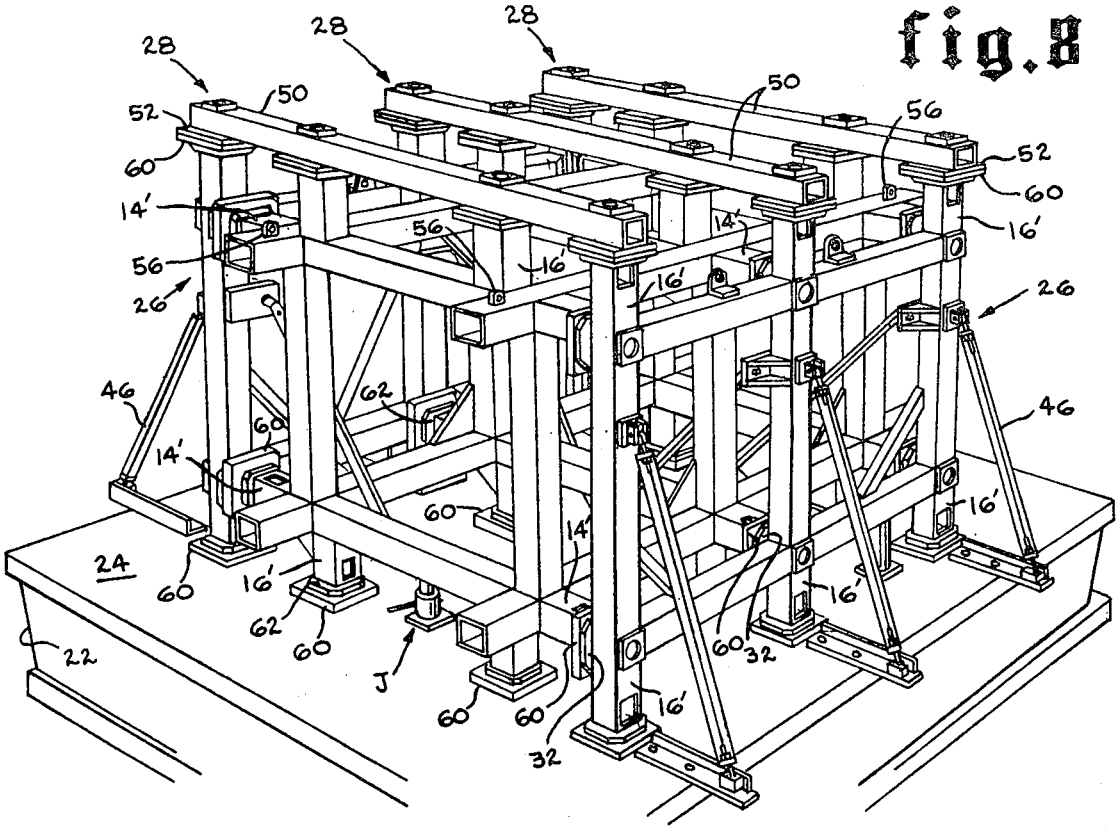
Figure 3:
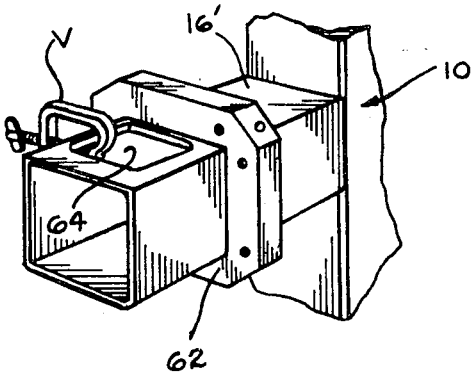
FIG. 3 illustrates one of the preliminary steps used in carrying out the invention, a flange collar being slidably mounted on a beam end and restrained against sliding to the termination of such beam end by a temporary clamp on the beam.
Figure 9:
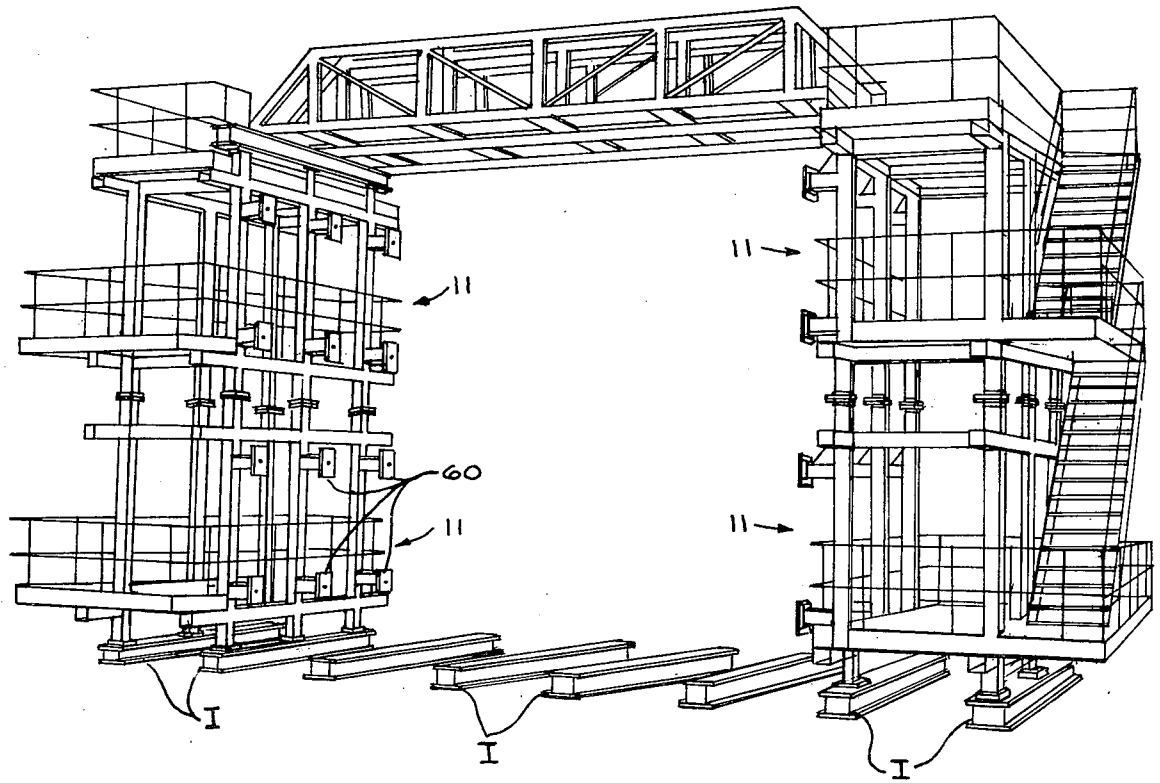

FIG. 8 is an overall perspective of the welded structure as flanged on four of its surfaces, together with the surface table and three grids which constitute the control media; and FIG. 9 is a perspective view showing how groups of the flanged frameworks may be arranged in stacks, together with other structural components, to form a complete assembly which may be used for the assembly of a spacecraft fuselage.

DETAILED DESCRIPTION OF THE DRAWING FIGURES

Figure 1:
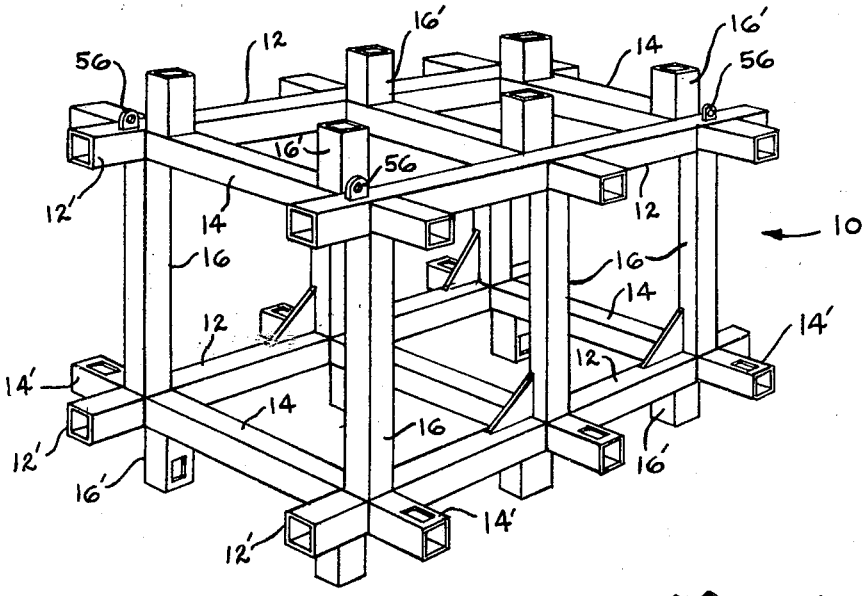
FIG. 1 is a perspective view of a three-dimensional welded framework structure prior to adding the flanges of the present invention.

Turning to FIG. 1, it will be seen that the framework to be flanged is basically a rectangular parallelepiped 10 having the usual six surfaces, twelve edges and eight corners. If the projecting beam ends are ignored for the moment, it will be noted that the basic framework is defined by three sets of box beams extending in the three mutually orthogonal directions, four lengthwise beams 12, four cross beams 14, and four vertical beams 16. In addition, there are two extra cross beams 14 and two extra vertical beams 16 disposed midway along the length of and extending between lengthwise beams 12.

The beams illustrated are standard steel tubing having a generally square configuration, with slightly rounded configuration, e.g., 20.3 cm. (8 inches) square. They are used in an unmachined condition, and are welded together at their intersections.

Projecting from each surface of the welded structure are a number of beam ends which are either welded to the beams or, as in the case of the lengthwise beams, are continuations of the beams themselves; these have been designated 12' for lengthwise beam ends, 14' for cross beam ends and 16' for vertical beam ends to show their association with the beams proper, even though some of the beam ends are offset with respect to their corresponding beams. For the particular construction illustrated, lengthwise beam ends 12' are not to be provided with flanges, although this could be done, if desired, in the same manner as will be described for the sets of beam ends 14' and 16' projecting from the other four surfaces.

In building the framework thus far described, efforts are made to maintain the lower beam ends 16' with predetermined spacings between their center lines, to keep them parallel to one another, and to have their lowermost edges terminate in a common plane, and similar efforts are made with respect to each other set of beam ends. Also, efforts are made to have the lower termination plane parallel to and spaced a predetermined distance from the plane approximately containing the terminations of the upper beam ends, and likewise with respect to the terminations of the projecting ends of the cross beams. Also striven for are accurate, predetermined relationships between the vertical and horizontal planes ideally defining these sets of terminations, to make them intersect at right angles and along a predetermined location.

The problem solved by the present invention is that such desired results cannot be achieved with any degree of accuracy with the welded construction thus far described, nor can it be achieved by welding flanges onto the beam ends. The welding process produces distortions in the welded members, distortions which are not wholly predictable. Final dimensions differ significantly from the desired dimensions, and parts are never quite parallel or co-planar or spaced within the desired tolerances. Fairly close approximations of the desired result may be achieved, but the approximations are so far out of tolerance that predrilled holes do not align to receive connecting members, loads are not transmitted along straight lines, and the like.

To obtain the desired accuracy, the present invention makes use of flanges attached to the beam ends by connecting members, completely avoiding welds. For each set of beam ends, use is made of a construction aid in the form of a platform having a completely flat surface, either continuous or interrupted, e.g., a surface table or grid plate, and the various such surfaces are disposed with respect to one another in accurate angular relationship to intersect along accurately prelocated lines. The basic concept is then to build the flanges onto these accurately located flat surfaces and insert the welded structure into the flanges; the flanges are then fixed to the beam ends of the welded structure before the flanged framework is removed from the control media, or set of platforms.

Figure 2:
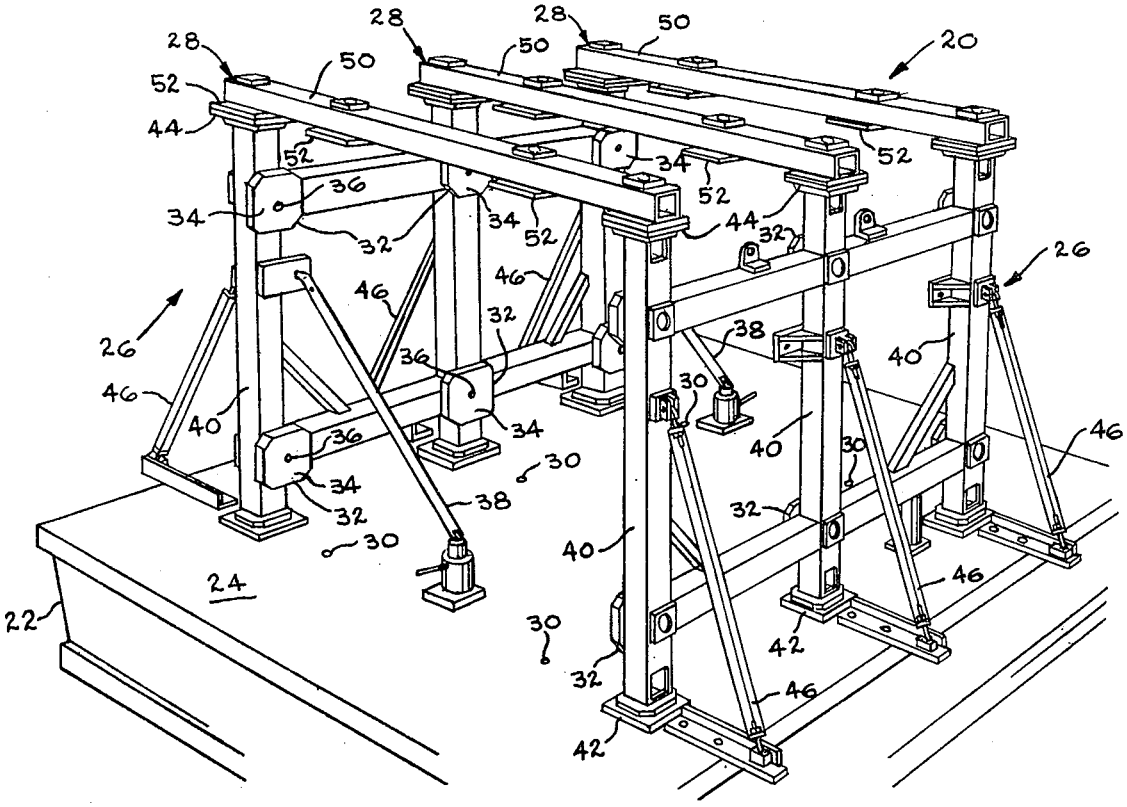
FIG. 2 is a perspective view of the "control media" used to assemble the flanges of the invention to four sets of the projecting beam ends of the welded structure shown in FIG. 1 (bottom surface, top, and the two long sides)

Such a control media 20 is illustrated in FIG. 2, and is seen to consist of the horizontal platform or surface table 22 having the very flat upper surface 24, a pair of spaced apart vertical grids 26, and the upper plateform or set of bridging members 28 secured to the tops of vertical grids 26. Formed in surface 24 are a set of vertical holes 30 which are accurately located with respect to both the vertical grids 26 and with respect to one another. The spacing between holes 30 conforms accurately to a predetermined pattern which corresponds to the approximate center line spacing between the lower beam ends 16'. The first step in the flanging process is to lay a set of flange plates or pads 60 (see FIG. 4) over the holes 30 so that the center holes 61 (see FIG. 5) of the plates register with the holes 30, after which a temporary pin is dropped through each pair of holes to prevent lateral shifting. The plates are also arranged so that corresponding side surfaces are all parallel to one another, whereupon a temporary toe clamp is attached between each flange plate and the surface table to prevent the plates from rotating.

Since the invention is not directed to the grid assemblies 26, only a limited description appears necessary. The most significant fact is that each grid 26 supports a number of pads 32 having co-planar inwardly facing surfaces 34, the common plane being perpendicular to surface 24 of the surface table. Each pad 32 has a hole 36 through the center thereof, and the holes 36 are accurately spaced from one another according to a predetermined pattern which conforms to the desired spacing pattern for the cross beam ends 14'.

Otherwise the vertical grid assemblies 26 may be summarized by saying that each is a rigid vertical framework. The interior braces 38 are readily removable, and are installed only after the welded structure is supported within the control media 20, as shown in FIG. 8. It is significant that the columns 40 of the grid are accurately formed to a uniform common height, measured from the lower surface of bottom pad 42 to the upper surface of top pad 44; this makes such upper surfaces co-planar and uniformly spaced from surface 24. The exterior braces 46 serve the primary purpose, of course, of maintaining grids 26 rigid and vertical with respect to the surface table. While not shown in detail, the braces and grids are disposed and connected so that a limited amount of lateral shifting of each grid 26 is possible, along center lines connecting the opposed center openings 36 in pads 32. This makes it possible, when bridging members 28 and braces 38 are removed, to open up the control media when the welded structure is being lowered to a nested position between the grids, and avoids collisions therebetween. The grids may then be moved back toward one another, until they are separated by a predetermined distance and each is a predetermined distance from a plane defined by reference to the surface table 22, e.g., a vertical plane passing through the right hand series of holes 30.

The bridging members 28 are simply uniformly made beams 50 having a series of pads 52 secured to their nether surface. As in the instance of the various other pads mentioned above, pads 52 are plates of uniform thickness having accurately formed upper and lower planar surfaces. When the end members of the group of pads 52 are secured to the upper surfaces of pads 44 of the grid assemblies 26, the lower surfaces of all pads 52 lie in a common plane spaced a predetermined distance above surface 24 of surface table 22. Each pad 52 has a vertical center hole formed therein (not shown) and the intermediate pads 52 are located along the length of beams 50 so that such center holes lie directly above holes 30 of the surface table, i.e., so that the extended vertical center line of each hole 30 passes through the center line of a center hole in a pad 52. In other words, the spacing of the center hole in pads 52 is identical, within a very close tolerance, to the predetermined spacing pattern used in forming holes 30.

Figure 5:
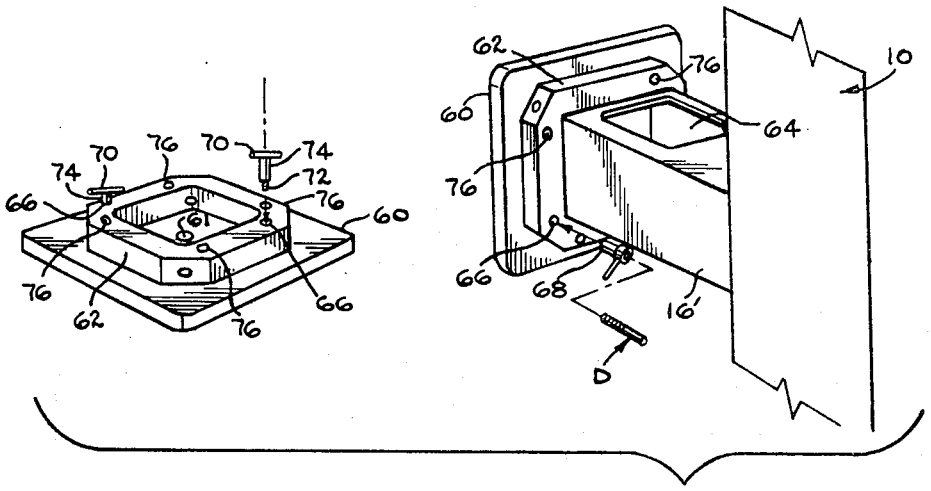
FIG. 5 illustrates the use of a special bushing to spot drill a pair of holes in the pad which are accurately aligned to be coaxial with preformed openings through the collar, followed by the use of special step pins inserted in such openings, such openings and holes being critical because they will later be drilled and reamed to receive dowels.
Figure 6:
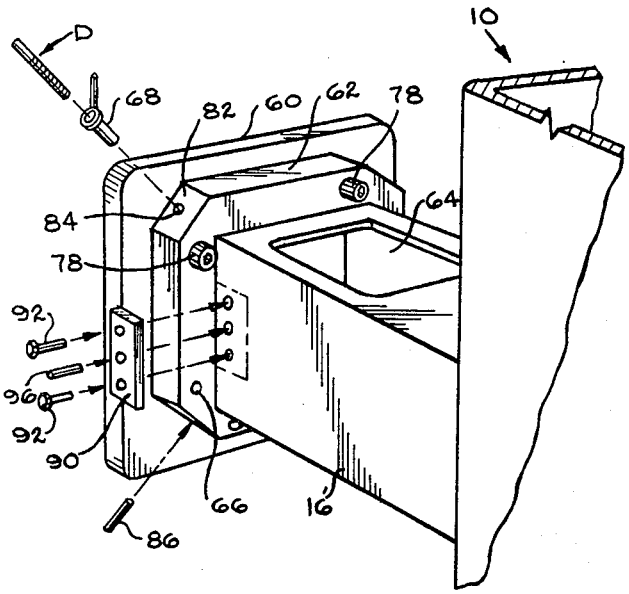
FIG. 6 illustrates two things, one being the use of the same special bushing and a drill bit to drill lateral holes through the walls of the tube (beam end) through preformed lateral openings in the chamfered corners of the flange collar, and also showing a shear and gage pad and its connection to the beam end.
Figure 7:
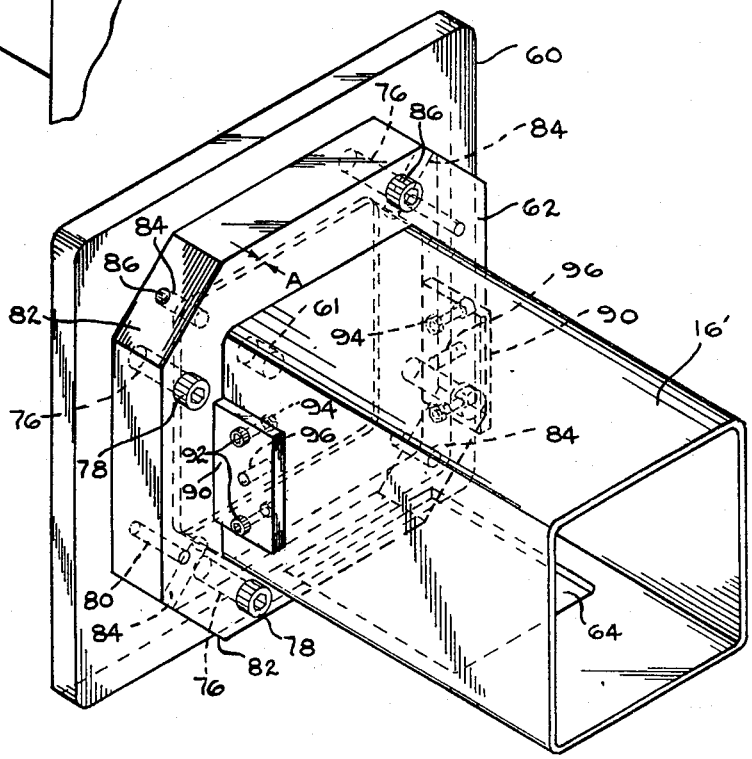
FIG. 7 is a perspective view showing a completed flange assembly in complete detail, hidden parts being shown in phantom to remove any doubt as to their presence.

FIGS. 3–6 illustrate various and progressive steps in building a flange onto a beam end, while FIG. 7 illustrates a complete assembly. Since the lower beam ends 16' are the most difficult to flange, one assembly of a 16' end will be described in detail, and the reader can then safely assume that the other assemblies are made in a similar manner. At about the same time that the first step mentioned above is made (temporarily pinning and clamping a set of plates 60 to the surface table) the same number of collars 62 are slidably mounted on the beam ends 16', one collar per end, and are temporarily restrained from dropping off by the indicated C-clamps V, utilizing the access opening 64 near the free end of beam end 16'. By way of example for the described 20.3 cm. (8-inch) square box beams used, e.g., with a center-to-center spacing of 178 cm. (70 inches), collar 62 may be made of hot rolled steel, have a thickness of 5.08 cm. (2 inches), and have cross-sectional dimensions of 33 cm. by 33 cm. (13 inches by 13 inches), with square-cornered chamfers. The various laterals openings in the collars will be mentioned below; the main opening, which receives beam end 16', is sufficiently larger than the corresponding dimensions of the beam end 16' as to permit ready sliding until the two members are secured together.

Figure 4:
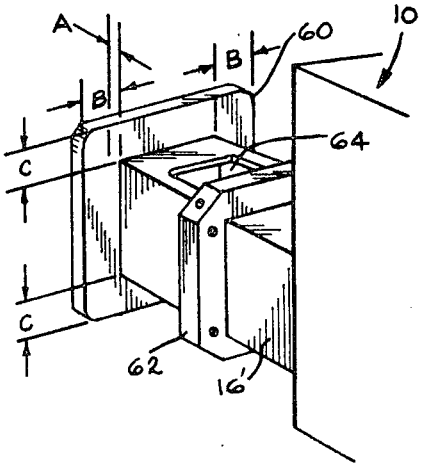
FIG. 4 illustrates how a beam end is centered on a flange pad and is slightly spaced from its inner surface.

FIG. 4 shows that the beam end 16' is approximately centered on flange pad 60. A suitable pad 60 would be made of hot rolled steel and have dimensions, e.g., of 2.54 cm. (1.0 inch) in thickness, with width and length both equal to 40.6 cm. (16 inches). With beam ends 16' approximately spaced from each other according to the predetermined pattern, the extremity of an end will neatly divide the surface of pad 60 so that the two dimensions B and the two dimensions C are all approximately equal to 10.16 cm. (4 inches). These are not critical dimensions, however, as one purpose of the invention is to provide accurately spaced flanges even though the beam end spacing may only roughly conform to the desired spacing The dimension "A" has been added to FIG. 4 to emphasize the fact that a gap is left between the free terminations of beam ends 16' and pads 60, or in other words, beam end 16' is partly and incompletely received in collar 62. This dimension may be, for example, about 0.635 cm. (¼-inch). The gap A is maintained during assembly be seating weld structure 10, through the use of a crane and the four crane eyes 56, on three or more adjustable jacks J seated on surface 24. Sets of pads 60 are secured to the grid plates 32 and to the pads 52 of the upper bridging members 28 in the same manner as for the surface table (clamps may be used in place of pins), and sets of collars are slid onto all three sets of beam ends: upper ends 16' and both sets of cross beam ends 14'. Thereafter the grids 26 can be moved into final position, spaced apart a predetermined distance from each other and from the reference plane passing through holes 30 of the surface table, and the upper horizontal grid (bridging members 28) may be secured to grids 26. All that remains is to bring the sets of collars 62 into contact with their matching pads 60, and the assembly will take the appearance shown in FIG. 8 (from which all temporary clamps have been omitted in the interest of clarity).

Once the welded structure has been disposed so that all four sets of terminations of its sets of beam ends confront the control media disposed according to the predetermined spacings and relationships outlined above, the remaining steps all have the objective of integrating each beam end to its surmounted flange to preserve such spacings and relationships. Once this is done all 24 flange pads may be finally released from the control media, with the assurance that the flanged framework will be essentially identical to both its predecessors and its successors, i.e., such frameworks will be replaceable assemblies and can be stacked together by merely dropping connectors through registering holes.

FIG. 5 shows a first step in the method and means utilized by the inventor to secure a flange collar 62 to its pad 60, a means which permits the two parts to be temporarily disassembled and later reassembled exactly as before. It should be noted first, however, that the collar 62 is prevented from sliding along beam end 16' by shims (not shown) driven into the slight gaps between these two members. At this stage in the assembly the pads 60 are all tightly secured to the control media, which is too bulky to be budged, and the welded structure is fixed in place by virtue of its own weight, resting on jacks J.

As seen in FIG. 5, there are a pair of predrilled holes 66, through the thickness thereof and at approximately diagonally opposed locations; these holes 66 may, for instance, be of 0.952 cm. (⅜ inch) in diameter. A special bushing 68 is alternately inserted in each of holes 66, such bushing having an outer diameter so that it is snugly yet slidably received in the hole, without wobbling. Bushing 68 has a central opening of uniform diameter extending therethrough, and the wall of this opening may be case hardened to resist inadvertent gouging. Such opening has a bore to receive snugly the bit D of a drill in such manner that the bit can slide and rotate within the opening and yet will not wobble therein. With bushing 68 in hole 66, drill bit D and its associated drill (not shown) are inserted to the bottom of the hole and operated to spot drill a pair of holes in pad 60, e.g., 0.635 cm. in diameter by 0.476 cm. deep (¼ inch dia. by 3/16 inch deep). By virtue of the use of the bushing, this spot-drilled hole will be accurately aligned and coaxial with hole 66. (The spot-drilled hole is not shown in any figure; it is later enlarged and reamed to form a hole which receives a dowel pin 86).

After forming such registering openings, the welded structure may be removed from the control media, as deemed necessary for the further steps described below, and the collars 62 and pads 60 may be removed from the beam ends. Before doing so, it is advisable to apply serial numbers to each set of the 24 sets, one number for each pad, collar and beam end in a set.

The next step is to insert a pair of special step pins 70 in the pair of stepped openings, each consisting of a hole 66 through collar 62 and the underlying spot-drilled hole in the top of plate or pad 60. Each step pin 70 has a smaller diameter portion 72 received in the spot-drilled hole and a larger diameter upper portion 74 receivable in hole 66, both portions being received snugly yet removable and without wobble. Temporary clamps are then used to hold the pair of step pins, collar and pad together.

While thus clamped, a set of four machine screw holes 76 are drilled through the thicknesses of both collar 62 and pad 60, e.g., of 1.35 cm. (17/32 inch) in diameter, one on each of the four sides of the members. (The holes through collar 62 may be pre-drilled to save time in the assembly step.) The collar portions of the holes 76 are then counterdrilled, e.g., to 1.67 cm. (21/32nds) diameter, while the pad portions are tapped, e.g., for 1.59 – 11NC (⅝ inch - 11NC) fillister headed machine screws 78. The machine screws are added and tightened in place. It will be apparent that, when such machine screws 78 are slightly loosened, a slight amount of lateral shifting of the collar on the pad is possible.

With machine screws 78 tightened, the special step pins 70 are removed and laid aside; they have served their function. The pair of holes 66 in collar 62 and the pair of underlying spot drilled holes in pad 60 are now drilled out and reamed to receive 1.27 cm. (½ inch) diameter dowel pins extending through both members.

If the welded structure and flanges were not previously removed from the control media, as suggested above, the dowel pins 80 are driven home in the reamed-out holes 66. On the other hand, if the suggested disassembly was performed, the better procedure is to reassemble all parts to the control media with some caution. The suggested procedure is initially to fasten only two collars 62 to pads 60 by pairs of dowel pins 80, and to return these preselected sets to their original locations at diagonally opposite corners of surface table 22, again pinning them through holes 30 and aligning pads 60 parallel to one another. The other sets of collars and pads are disassembled, and the twenty-two pads returned and secured, as before, to their original locations on the surface 24, grids 26, and the bridging members 28 of control media 20.

Thereafter the other twenty-two collars 62 are returned to the welded framework 10 and temporarily clamped thereon as necessary. The frame work 10 is returned to the control media 20 and aligned with respect thereto, as before, using jacks J, etc., to maintain a spacing between all the terminations of the beam ends and the adjacent pads 60. Collars 62 are then once more brought into contact with their respective pads 60, and secured thereto with the machine screws 78, and finally the remaining dowel pins 80 are driven home in holes 66.

Whichever procedure is followed, the end results are that the welded framework 10 is supported within control media 20 in the desired spatial relationship to all twenty-four flanges, both parts 60 and 62 are permanently secured together, and all flanges are disposed to have the desired spatial relationships, both to one another and to the welded structure. All that remains is to permanently secure the flange subassemblies to the beam ends, and the manner of doing this is illustrated in FIG. 6. Use is made of four preformed holes 84 extending laterally and diagonally through collars 62, one hole through each chamfered corner 82 and centered between the ends thereof — but preferably not centered between the upper and lower faces of the collar; it is recommended that holes 84 be formed in the upper half of the collar thickness, that half more distant from the junction with pad 60, to avoid any problem that might arise from the fact that beam end 16' is only partially received within collar 62, leaving the gap A between the termination of the beam end and the adjacent surface of pad 60, as shown in FIGS. 4 and 7.

Holes 84 are originally of the same diameter as holes 66, so use is again made of special bushing 68, now disposed in a hole 84. The same drill bit D may be inserted in bushing 68 and used to spot drill the corner of tube or beam end 16'. Since the tube wall is not particularly thick, the 0.635 cm. (¼ inch) hole formed by drill bit D is drilled all the way through this wall, There is no need to use a special step pin, and the next step is to drill out holes 84 and the smaller, coaxial holes in the tube wall to 1.19 cm. (15/32 inch) diameter, then ream then out to 1.27 cm. (½ inch) to receive dowel pins 86. These dowels are driven home, and the assembly is essentially complete.

FIGS. 6 and 7 also show the addition of a pair of shear and gage plates 90 mounted flat against opposed side walls of tube end 16' and with one edge flush with the upper face of collar 62. This is preferably done with the spaced pair of machine screws and nuts 92 and 94, and a center dowel pin 92 driven through registering openings in both members.

FIG. 9 shows how the modular frameworks of the invention may be combined to build up an overall tooling assembly for the construction of spacecraft, locomotives, sea-going vessels, etc. Using the reference character 11 to indicate one of the three-dimensional frameworks after it has been properly flanged according to the above, it will be seen that there are two such modules 11 stacked one on top of the other at the left of the assembly, and a similar stack of two modules 11 at the right. Each stack was assembled simply by placing one module on top of the other so that the center holes in upper pads 60 of the lower module 11 register with the like set of center holes in the lower pads of the upper module, and then dropping connecting members through the registering openings. Theh lower modules are secured to pairs of a series of floor beams I which are grouted to the floor so that their upper surfaces lie in a common plane. Such beams are not part of the present invention, but do illustrate its manner of use, as do the other added structures — the illustrated bridge spanning the two stacks of modules, flooring, stairs, guard rails, etc. It should be noted that the inwardly facing vertical grids provide ample space for workers to view their work and for mounting tools to extend out thereto, that pads 60 form a common reference plane from which to make measurements, and that the center holes in the pads provide reference points for vertical and lateral measurements.

Having explained a particular embodiment of the invention, it is to be understood that the invention is not limited to that embodiment, as the same was intended only by way of illustration. The scope of the invention is only that indicated in the following claims, and by all equivalents which will occur to those skilled in the art from a study thereof.

I claim:

1. In a three-dimensional framework which includes at least one set of elongated beam members having free ends projecting outwardly from the balance of the framework and terminating approximately but imperfectly in a common plane, such beam members being approximately parallel and roughly but imperfectly spaced from one another according to a predetemined pattern, the improvement comprising flanges secured to said ends of the set of beams, each said flange including a collar fixed to and surrounding one of said beams to partially receive the end thereof and a pad or plate fixed to said collar, each said pad being wider and longer than the collar and having an outer surface and an accurately formed center hole through its thickness, said pads being disposed so that their outer surfaces are co-planar and their center holes are accurately spaced from one another according to said predetermined pattern, a first set of connecting members securing said collar to the beam and a second set of connecting members securing said collar to the pad.

2. In the improved framework of claim 1 in which said one set of beams has a second set of free ends projecting outwardly from the opposite side of the balance of the framework, the further improvement comprisng a second set of flanges secured to said second set of free ends of the beams, said second set of flanges having the same components and holes and being secured to the second set of beam ends in the same manner so that the outer surfaces of the second set of flange pads lie in a common plane which is parallel to the common plane of the outer surfaces of said first set of flange pads and the center holes of said second set of flange pads are accurately spaced from one another according to the same predetermined pattern as are the center holes in the first set of pads.

3. The improved framework of claim 2 in which the two sets of flange collars are disposed so that the extent to which they receive their respective sets of beam ends defines a predetermined spacing between the pair of parallel planes defined by the outer surfaces of the two sets of flange pads.

4. The improved framework of claim 1 which further includes at least one shear and gage plate secured to a surface of one of said beams adjacent the end thereof, said shear and gage plate being disposed with one of its edges abutting said collar, and a set of connecting members securing said plate to said beam.

5. The improved framework of claim 4 in which there are two said shear and gage plates secured to surfaces of one of said beams, both said plates abutting said collar and secured to the beam by sets of connecting members, said plates preferably being secured to surfaces of said beam which are spaced 180 degrees apart.

6. In the improved framework of claim 1 which includes a second set of elongated beam members having free ends projecting outwardly from the balance of the framework, such second set of beams being approximately perpendicular to the first, the further improvement comprising a second set of flanges secured to the ends of said ends of the second set of beams, said second set of flanges having the same components and holes and being secured to the second set of beams in the same manner, the outer surfaces of the pads of said second set of flanges lying in a plane perpendicular to the plane defined by the outer surfaces of the first set of flanges, the center holes of said second set of pads being accurately spaced from one another by predetermined distances.

7. The improved framework of claim 6 in which the two sets of flange collars are disposed so that the extent to which they receive their respective sets of beam ends define predetermined distances between the holes through the flange pads of either set of such pads and the common plane defined by the outer surfaces of the other set of such pads.

8. A method of flanging a set of beam ends projecting from a three-dimensional welded framework having at least one set of approximately parallel beams with such ends terminating approximately but imperfectly in a common plane and with the centers of the beam ends roughly spaced from each other according to a predetermined pattern, so that flanges are secured to said ends to define a common plane containing the outer surfaces of all of such flanges and the centers of the flanges are accurately spaced from one another according to a predetermined pattern, said method comprising the steps of 1. removably securing a set of pads or plates to a surface table at accurately predetermined spacings according to said predetermined pattern, said pads being pinned to the surface table through center holes in the pads and with the edges of each pad parallel to the correspondingly disposed edges of the other pads,
2. slidably mounting on said beam ends a set of collars having cross-sectional dimensions intermediate the corresponding dimensions of the pads and beam ends,
3. moving said three-dimensional framework toward said surface table until said beam ends are approximately centered on said pads and with the terminations of said ends spaced away from the pads a distance less than half the thickness of said collars, said set of beams being as nearly perpendicular to said surface table as possible,
4. temporarily supporting the framework in such position,
5. bringing said collars into contact with said pads,
6. shimming said collars to the beam ends to prevent further sliding of the collars,
7. securing said collars to said pads by a group of connecting members which include a set of dowel pins disposed in accurately registering reamed holes in said collars and pads, and a set of headed machine screws passing through unthreaded holes in the collars and threaded into tapped holes in said pads, and
8. securing said collars to said beam ends by dowel pins passing through accurately registering reamed holes through the thickness of said collars and beam ends.

9. The flanging method of claim 8 which includes, between the sixth and seventh steps thereof, the following additional steps:

6a. disposing a special bushing in a pair of preformed, opposed holes through the thickness of said collars, said bushing being received snugly in said holes and having a center opening permitting the snug reception of a predetermined size of drill bit while permitting the rotation of the bit,

6b. spot drilling a hole into said pad through said bushing and each of said performed holes through said collar,

6c. removing said three-dimensional structure from the surface table, together with the flange collars and flange pads, keeping said beam ends, collars and pads in identifiable sets,

6d. re-registering said collars to said pads by special step pins passing between the matching members and clamped in place, said step pins having concentric portions of two different diameters, the smaller diameter portion thereof being snugly received in the hole spot drilled in the pad while the other portion, of larger diameter, is snugly received in the registering preformed hole through the collar, and, during said seventh step,

7a. removing said special step pins after connecting the collars and pads together with said machine screws but prior to adding said dowels, and, in the same time interval,

7b. remounting said pads, collars and the three-dimensional welded framework on said surface table with the same relative dispositions as at the end of step 5.

10. The flanging method of claim 8 which includes the further step of

9. securing to each said beam end a number of shear and gage plates, each said plate being butted against the adjacent collar and secured to said beam end by mating nuts and machine screws, and by a dowel pin driven into a pair of registering openings in said shear and gage plates and beam end.

11. The flanging method of claim 10 in which said further step includes securing a pair of said shear and gage plates to each said beam end, disposing said shear and gage plates on opposed parallel walls of said beam ends.

12. The flanging method of claim 8 which further includes flanging a second set of beam ends projecting from the three-dimensional welded framework, said second set of beam ends forming an angle with the first set and being similar to the first set in being approximately parallel to one another, terminating approximately but imperfecly in a common plane, and with their centers roughly spaced from one another according to a predetermined pattern, said method comprising the additional steps of bringing into the proximity of the terminations of said second set of beam ends a grid structure having an inner surface facing said beam end terminations and spaced therefrom, said surface being accurately planar and accurately defining a predetermined angle with said surface table, said grid including pads facing said beam ends and approximately centered thereon, said grid surface containing center holes accurately spaced from said surface table and from one another, according to said predetermined pattern, and repeating the steps of claim 8 with respect to said second set of beam ends and said grid.

13. The flanging method of claim 12 further including the step of securing said grid structure to said surface table in a perpendicular relationship thereto.

14. The flanging method of claim 12 further incuding the step of securing said grid structure in a location such that its inner surface is parallel to the upper surface of the surface table and at a predetermined spacing therefrom.

* * * * *